United States Patent [19]

Van Vliet

[11] 4,355,918

[45] Oct. 26, 1982

[54] SPACE FRAME CONNECTORS

[75] Inventor: Marius Van Vliet, Johannesburg, South Africa

[73] Assignee: Design Research Marketing (Proprietary) Limited, Johannesburg, South Africa

[21] Appl. No.: 210,357

[22] Filed: Nov. 25, 1980

[30] Foreign Application Priority Data

Nov. 26, 1979 [ZA] South Africa ..... 79/6383
Feb. 29, 1980 [ZA] South Africa ..... 80/1191

[51] Int. Cl.[3] ..... F16D 1/00; F16D 3/00; F16L 41/00

[52] U.S. Cl. ..... 403/170; 52/81; 403/218; 403/373

[58] Field of Search ..... 403/169–176, 403/217, 218, 405, 373, 310, 312; 52/81

[56] References Cited

U.S. PATENT DOCUMENTS 3,309,121 3/1967 Fentiman ..... 403/176
3,476,278 12/1969 Woods ..... 403/172 X
3,635,509 1/1972 Birkemeier ..... 403/173
3,789,562 2/1974 Chicchis ..... 403/176 X
3,877,824 4/1975 Jury ..... 403/176 X
3,882,650 5/1975 Gugliotta ..... 403/176 X
4,027,449 6/1977 Cilveti ..... 403/176 X

*Primary Examiner*—Wayne L. Shedd
*Attorney, Agent, or Firm*—Oblon, Fisher, Spivak, McClelland & Maier

[57] ABSTRACT

This invention relates to a connector for the elongated frame elements of a structural space frame and to a space frame employing the connectors. The connectors consist of three elements which are stacked one on the other on a common axis with the face of each element which abuts that of another including recessed formations which between the opposite element faces define sockets for trapping the headed ends of space frame members with the axes of the sockets between a first pair of element faces lying in a common plane and those between the second pair of faces being inclined relatively to and on the same side of the plane containing the axes of the sockets between the first pair of element faces and means for clamping the elements in the direction of their common axis.

8 Claims, 4 Drawing Figures

SPACE FRAME CONNECTORS

FIELD OF THE INVENTION

This invention relates to connectors or node members for joining elongated elements in a three-dimensional structural arrangement which is known as a space frame and to a frame including the connectors.

BACKGROUND TO THE INVENTION

Space frames are well known. The major problems with known frames are firstly, that the node connectors of three-dimensional frames generally consist of four or more cruciform clamping elements and a plurality of nuts and bolts or other fasteners which complicate erection of the frames, and secondly, result in untidy frames which are more often than not exposed to view. Yet a further disadvantage to known node connectors is that they rigidly clamp the ends of the tubular frame members making alignment of the structural members time consuming and difficult during erection of the frames.

OBJECT OF THE INVENTION

It is the object of this invention to provide a space frame connector and frame including the connectors which will minimise the above problems.

SUMMARY OF THE INVENTION

A space frame connector according to the invention includes three elements which are stacked one on the other on a common axis with the face of each element which abuts that of another including recessed formations which between the opposite element faces define sockets for trapping the headed ends of space frame members, with the axes of the sockets between a first pair of element faces lying in a common plane and those between the second pair of faces being inclined relatively to and on the same side of the plane containing the axes of the sockets between the first pair of element faces and means for clamping the elements in the direction of their common axis.

In one form of the invention the axes of all of the sockets pass through a common point on the common axis of the connector.

A space frame including connector nodes as described above includes elongated frame members extending between the connectors of the frame with each frame member including a tube, a solid member located on each end of the tube, threaded axial bores in the exposed ends of the solid members and headed studs adjustably engaged in the member bores with their heads anchored in the sockets of two of the frame connectors. Preferably, the solid members at the ends of the tubular frame members are spigots including locking formations which are located in the tube ends with the tube ends crimped into mechanical contact with the spigots and their locking formations.

BRIEF DESCRIPTION OF THE DRAWINGS

An embodiment of the invention is now described by way of example with reference to the drawings in which.

DETAILED DESCRIPTION OF THE INVENTION

Figure 1:
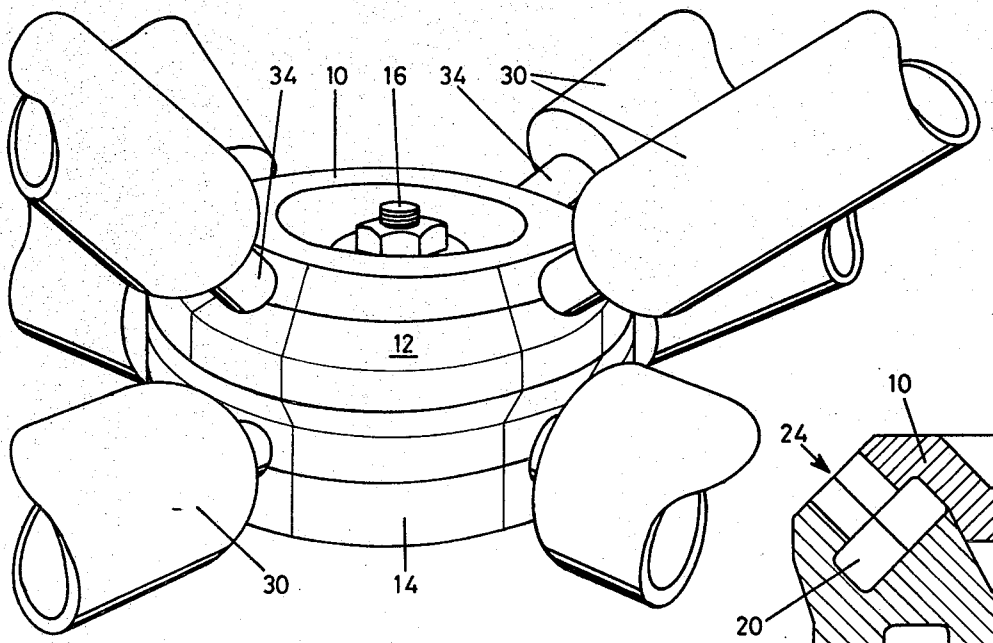
FIG. 1 is a perspective view of a fragment of a space frame surrounding a connector.
Figure 2:
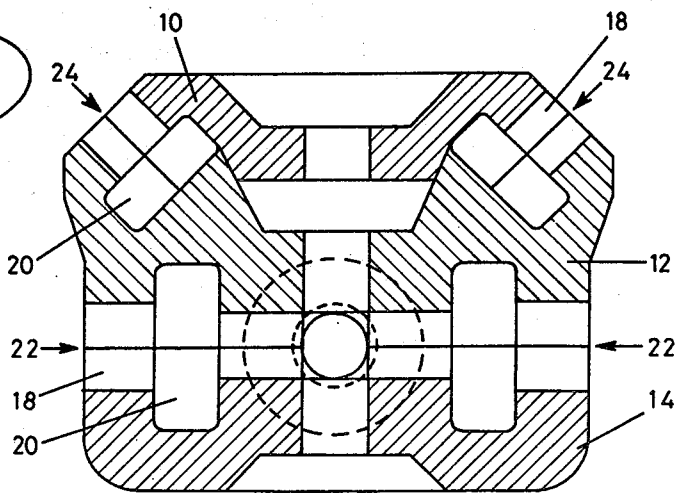
FIG. 2 is a sectioned side elevation of the connector of FIG. 1.
Figure 3:
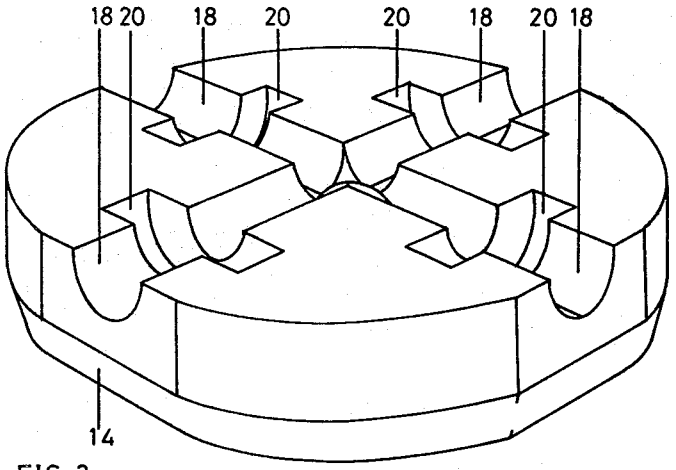
FIG. 3 is a perspective view of one of the elements of the connector of FIGS. 1 and 2.

The connector of the invention is shown in FIGS. 1 to 3 of the drawings to include three cast metal disc elements 10, 12 and 14 and a clamping bolt 16.

All three of the connector elements carry axial bores which as seen in FIG. 2 are in register to provide a passage through the connector for the bolt 16.

The abutting faces of the elements 12 and 14, as is more clearly seen in FIG. 3, each include cruciform semi-cylindrical grooves 18 which radiate from their central bores to the periphery of the discs and arcuate recesses 20 which are larger in cross-sectional shape than the grooves 18.

Although not shown in the drawing, one of the abutting disc faces could, and preferably does carry an upstanding circular key formation which is concentric with the bolt bore and positioned radially inwardly of the recesses 20. The remaining disc face could be grooved to receive the key to prevent relative movement of the elements in a direction transverse to their bolt bores.

When the element 12 is superimposed on the element 14 the grooves 18 and recesses 20 provide between them four radially directed sockets 22.

The abutting substantially frusto conical faces of the elements 10 and 12 carry grooves and recesses similar to those which define the sockets 22 and provide four sockets 24, the axes of which are inclined at an angle of 45° to the plane containing the axes of the sockets 22. The element 10 is keyed to the element 12 against relative movement transverse to the bolt axis by a frusto conical formation 26 which is located in a complementally shaped well 28 in the element 12.

The upper and lower surfaces of the connector are recessed around the bolt hole to shroud the heat and nut of the bolt 16. Although the recesses are shown in the drawing to be outwardly chamfered, they could be cylindrical and the connector could include cover caps which are frictionally engaged in the recesses for covering the exposed bolt elements.

Figure 4:
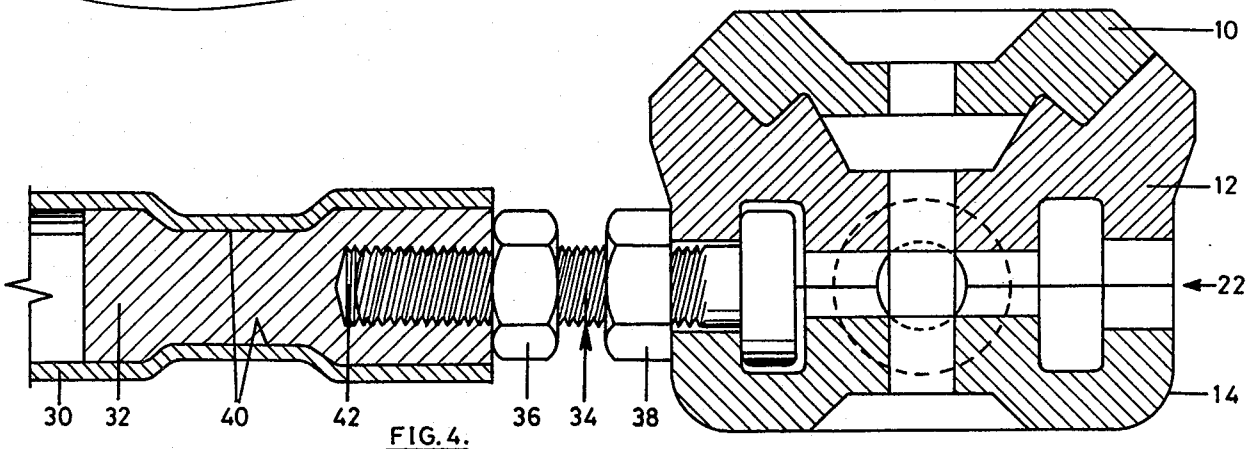
FIG. 4 is a sectioned side elevation of a second embodiment of the connector engaged with one end of one of the space frame members.

In the embodiment of the connector illustrated in FIGS. 1 and 2 the sockets 24 are located vertically above the sockets 22 but the sockets 24 could be, as illustrated in FIG. 4, rotated about the bolt axis to be located between and displaced from the sockets 22 by 45°.

One end of the frame members for use with the connector of the invention is illustrated in FIG. 4. The members each consist of a tube 30 having a spigot 32, a headed stud 34, and two locknuts 36 and 38 at each end.

The spigot in this embodiment is cylindrical in shape and includes two flats 40 on opposite sides and a threaded blind bore 42. The diameters of the threaded shank of the stud and its head are less than the diameters of the sockets in the connector so that the headed portions of the studs are a loose fit in the sockets to facilitate the alignment of the tubes 30 between the connectors to which they are anchored in a space frame.

The tube ends are crimped, to avoid temper problems and so zones of weakness, which could be caused by welding, into intimate contact with the spigots and their flats 40 which prevent withdrawal of the spigots from the tubes 30 under tension.

To tension the frame elements between the connectors the studs 34 on opposite ends of the elements are pulled up in the bores 42 of the spigots and locked in position by the nuts 36 and 38. Alternatively, the threaded elements of the frame members could be of opposite direction and the members tensioned between the connectors by rotating the tubes 30 much as one would with a turnbuckle.

I claim:

1. A space frame connector including three elements which are stacked one on the other on a common axis with the face of each element which abuts that of another including recessed formations which between the opposite element faces define sockets for trapping the headed ends of space frame members, with the axes of the sockets between a first pair of element faces lying in a common plane and those between the second pair of faces being inclined relatively to and on the same side of the plane containing the axes of the sockets between the first pair of element faces and means for clamping the elements in the direction of their common axis.

2. A connector as claimed in claim 1 in which the elements are holed on their common axis and the clamping means is a bolt which is located in the aligned holes and pulled up against the outer elements of the stack.

3. A connector as claimed in claim 1 in which the three elements are disc shaped metal castings.

4. A connector as claimed in claim 1 in which the axes of all of the sockets pass through a common point on the common axis of the connector.

5. A connector as claimed in claim 1 in which the angle of inclination between the axes of the sockets between one pair of element faces and those of the sockets between the other element faces is between 30° and 60°.

6. A connector as claimed in claim 1 in which the formations which define the sockets are of a larger dimension than the ends of the members to be trapped in them.

7. A space frame including connectors as claimed in claim 1, elongated frame members extending between the connectors of the frame with each frame member including a tube, a solid member located on each end of the tube, threaded axial bores in the exposed ends of the solid members and headed studs adjustably engaged in the member bores with their heads anchored in the sockets of two of the frame connectors.

8. A frame as claimed in claim 7 in which the solid members at the ends of the tubular frame members are spigots including locking formations which are located in the tube ends with the tube ends crimped into mechanical contact with the spigots and their locking formations.

* * * * *